US007230195B2

(12) United States Patent
Ohnishi

(10) Patent No.: US 7,230,195 B2
(45) Date of Patent: Jun. 12, 2007

(54) BUTTON WATERPROOFING STRUCTURE

(75) Inventor: Tetsushi Ohnishi, Yokohama (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 0 days.

(21) Appl. No.: 11/396,610

(22) Filed: Apr. 4, 2006

(65) Prior Publication Data

US 2006/0225995 A1 Oct. 12, 2006

(30) Foreign Application Priority Data

Apr. 8, 2005 (JP) ..... 2005-112178

(51) Int. Cl.
*H01H 9/00* (2006.01)

(52) U.S. Cl. ..... 200/302.1; 200/302.2; 200/302.3; 200/310

(58) Field of Classification Search ..... 200/511, 200/512, 517, 302.1–302.3, 310, 314, 341–345, 200/296

See application file for complete search history.

(56) References Cited

U.S. PATENT DOCUMENTS 5,172,805 A * 12/1992 Gumb ..... 200/341
5,496,977 A * 3/1996 Date et al. ..... 200/6 A
5,704,467 A * 1/1998 Jarvis ..... 200/302.2
5,734,136 A * 3/1998 Newcomer et al. ..... 200/5 A
6,437,267 B1 * 8/2002 Imai ..... 200/302.1
6,443,644 B1 * 9/2002 Takeda et al. ..... 400/490
6,743,993 B1 * 6/2004 Clark et al. ..... 200/314
6,770,212 B2 * 8/2004 Hayashizaki ..... 216/28
6,868,259 B1 * 3/2005 Kitamura et al. ..... 455/90.3

* cited by examiner

*Primary Examiner*—Michael A. Friedhofer
(74) *Attorney, Agent, or Firm*—Eric J. Robinson; Robinson Intellectual Property Law Office, P.C.

(57) ABSTRACT

Button holes 3 are formed in a front panel 2. Buttons 4 are arranged in the button holes 3, and a rib 7 convexly provided on the back surface of the front panel 2 surrounds the button holes 3. A light transmitting rubber sheet 11 closes a space 30 surrounded by the rib 7 and is held between a circuit board 15 and the rib 7. Contact portions 12 are provided on the rubber sheet 11 so as to be brought into contact with and separated from the circuit board 15 by the elastic force of the rubber sheet 11. Light emitting elements 17 are mounted on the circuit board 15 so as to correspond to the buttons 4, and are accommodated in accommodation concave portions 18 in the rubber sheet 11.

8 Claims, 5 Drawing Sheets

BUTTON WATERPROOFING STRUCTURE

BACKGROUND OF THE INVENTION

1. Field of the Invention

The present invention relates to a button waterproofing structure.

2. Related Background Art

On-vehicle audio equipment is provided with buttons for pushing operation on a front panel. Since the on-vehicle audio equipment is used by being installed in a cabin, it is generally designed so as not to be waterproof. In the case where the audio equipment of this type is mounted on a ship, yacht, boat, motorcycle, and the like, rainwater, seawater, etc. may intrude through a gap between the button and the front panel. Therefore, the intrusion of rainwater, seawater, etc. is prevented by covering the button with a rubber (for example, refer to Patent Document 1).

Patent Document 1: Japanese Utility Model Application Laid-Open No. H3-28583

However, if the button is covered with a rubber, the design grade is low, and a sense of high class is lost.

SUMMARY OF THE INVENTION

Accordingly, an object of the present invention is to improve the design grade of a panel of electronic equipment such as audio equipment.

To achieve the above object, a first aspect of the present invention provides a button waterproofing structure in which a button is arranged in a button hole in a panel; a rib convexly provided on the back surface of the panel surrounds the button hole; a light transmitting rubber sheet closes a space surrounded by the rib and is held between a circuit board and the rib; a contact portion is provided on the rubber sheet so as to correspond to the button in such a manner as to be brought into contact with and separated from the circuit board by the elastic force of the rubber sheet; and a light emitting element is mounted on the circuit board so as to correspond to the button and is covered with the rubber sheet.

A second aspect of the present invention provides a button waterproofing structure of the first aspect of the present invention in which the rear-side tip portion of the rib is provided in a step shape; a step-shaped engagement groove is formed in the front surface of the rubber sheet so as to correspond to the rib; and the rib engages with the engagement groove.

A third aspect of the present invention provides a button waterproofing structure of the first or the second aspect of the present invention in which a drain hole penetrates from the lower surface of the panel to the rib.

A fourth aspect of the present invention provides a button waterproofing structure in which a concave portion is formed on the back surface of a panel; a button hole is formed at the bottom of the concave portion; a button is arranged in the button hole; a rubber sheet closes the concave portion and is held between a circuit board and the panel; and a contact portion is provided on the rubber sheet so as to correspond to the button in such a manner as to be brought into contact with and separated from the circuit board by the elastic force of the rubber sheet.

A fifth aspect of the present invention provides a button waterproofing structure in which a button is arranged in a button hole in a panel; a rubber sheet is arranged on the back surface side of the panel; a frame portion convexly provided on the front surface of the rubber sheet abuts on the back surface of the panel so as to surround the button hole, the frame portion being held between a circuit board that is in contact with the back surface of the rubber sheet and the panel; and a contact portion is provided on the rubber sheet so as to correspond to the button in such a manner as to be brought into contact with and separated from the circuit board by the elastic force of the rubber sheet.

A sixth aspect of the present invention provides a button waterproofing structure of the fourth or the fifth aspect of the present invention in which the rubber sheet has light transmitting properties; and a light emitting element is mounted on the circuit board so as to correspond to the button and is covered with the rubber sheet.

A seventh aspect of the present invention provides a button waterproofing structure of any one of the first to the sixth aspects of the present invention in which a concave portion is formed in the back surface of the rubber sheet; and the light emitting element is accommodated in the concave portion.

An eighth aspect of the present invention provides a button waterproofing structure of any one of the first to the seventh aspects of the present invention in which a light guide portion for guiding the light of the light emitting element to the button is provided between the button and the rubber sheet.

According to the present invention, even if water intrudes through the button hole, since the rubber sheet closes the space surrounded by the rib and is held between the circuit board and the rib, the water does not intrude farther.

Also, even if water intrudes through the button hole, since the rubber sheet closes the concave portion in the back surface of the panel and is held between the circuit board and the panel, the water does not intrude farther.

Also, since the frame portion convexly provided on the front surface of the rubber sheet abuts on the back surface of the panel so as to surround the button hole, and is held between the circuit board and the panel, even if water intrudes through the button hole, the water does not intrude farther.

Therefore, the circuit board and the light emitting element, which are located at the rear of the rubber sheet, can be waterproofed.

Also, since the rubber sheet is located at the rear of the button, and the button is not covered with the rubber sheet, the design grade is improved, and a sense of high class is enhanced.

Also, since the rubber sheet has light transmitting properties, the light emitted from the light emitting element lightens the button, so that the button shines. Therefore, the design grade is improved, and a sense of high class is enhanced.

DESCRIPTION OF THE PREFERRED EMBODIMENTS

Preferred embodiments for carrying out the present invention will now be described with reference to the accompanying drawings. The embodiments described below have various restrictions that are technically favorable for carrying out the present invention, but do not limit the scope of invention to the embodiments and examples illustrated below.

First Embodiment

Figure 1:
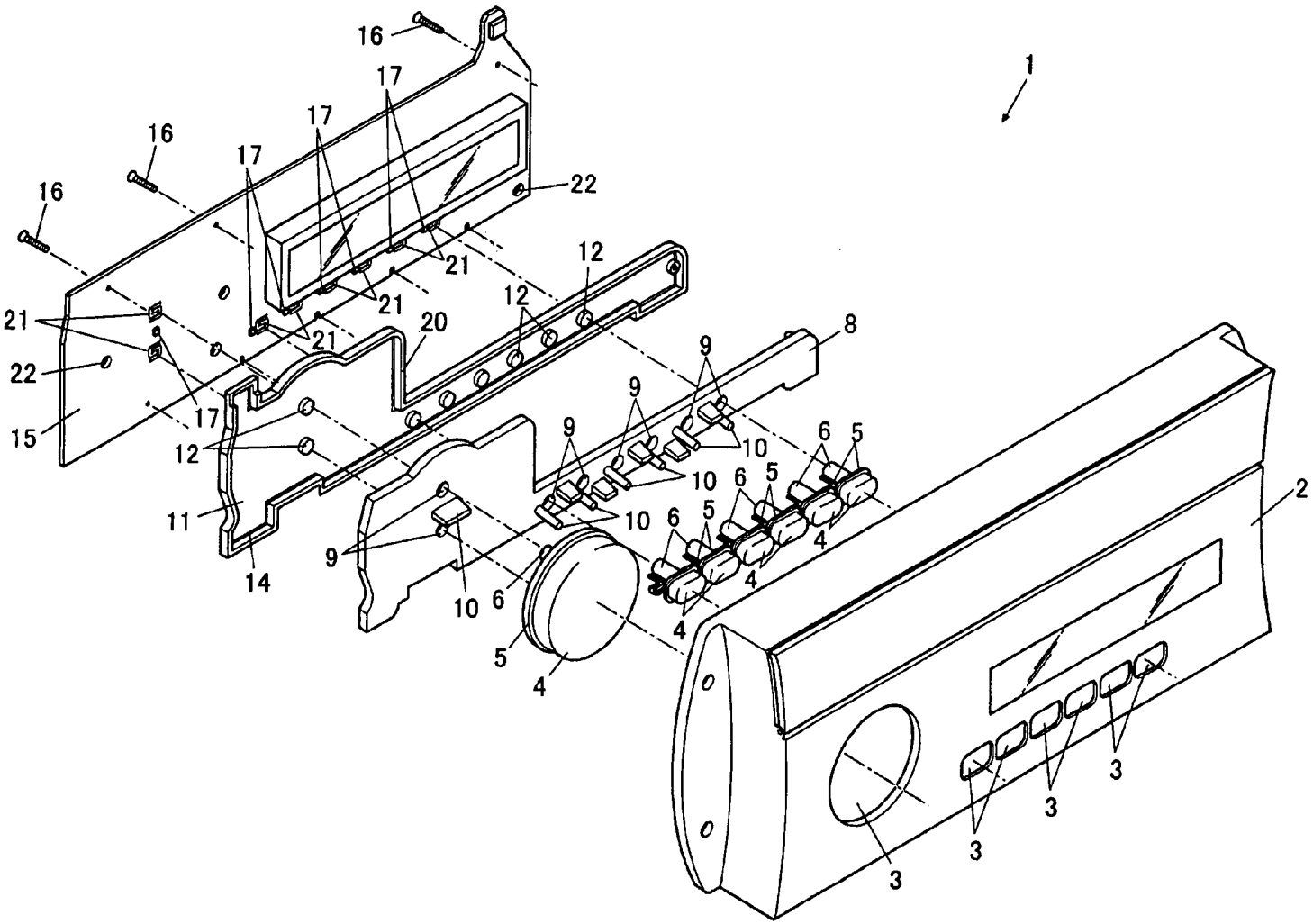
FIG. 1 is an exploded perspective view of a button waterproofing structure, viewed from the front.
Figure 2:
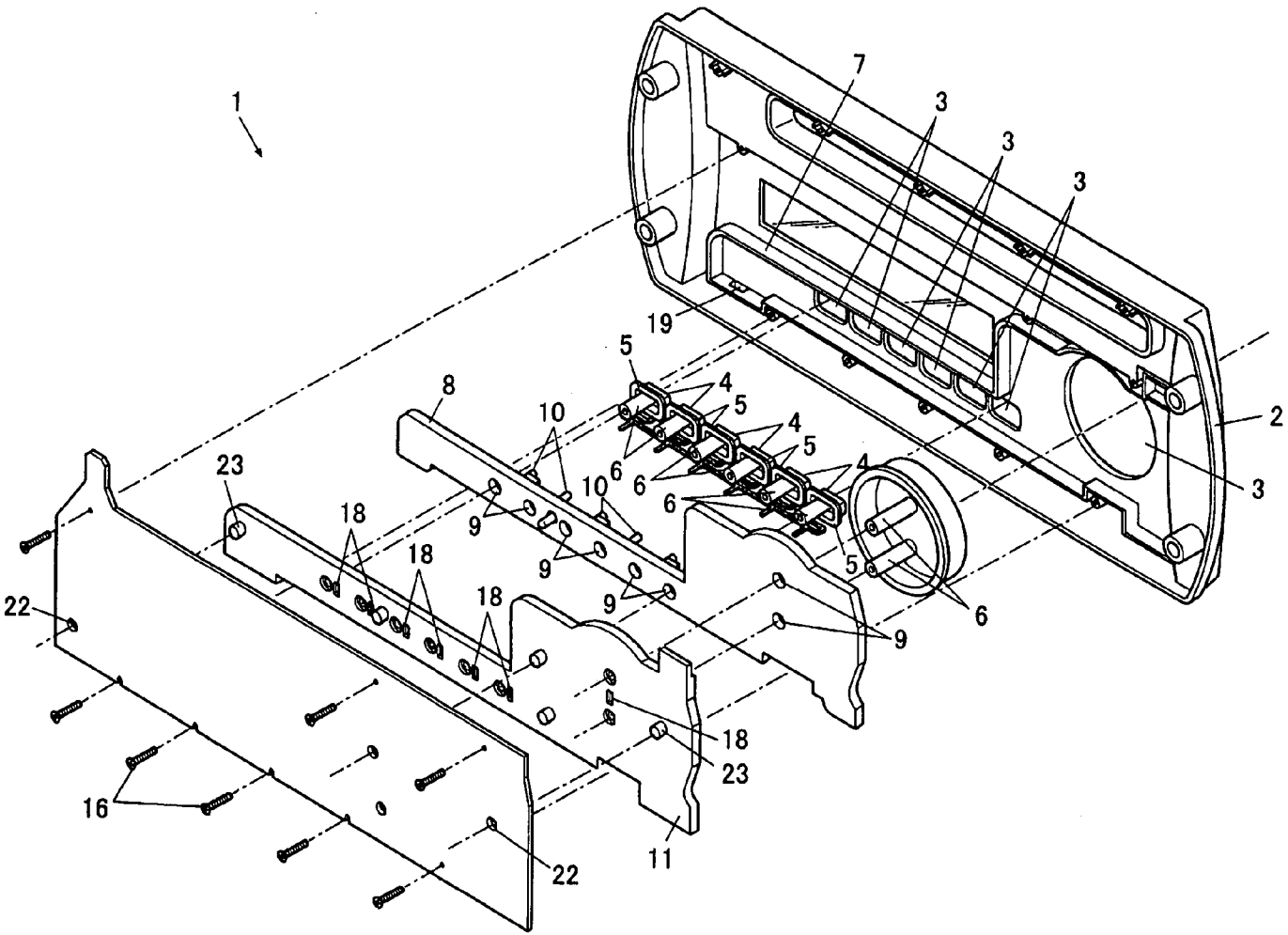
FIG. 2 is an exploded perspective view of a button waterproofing structure, viewed from the back.
Figure 3:
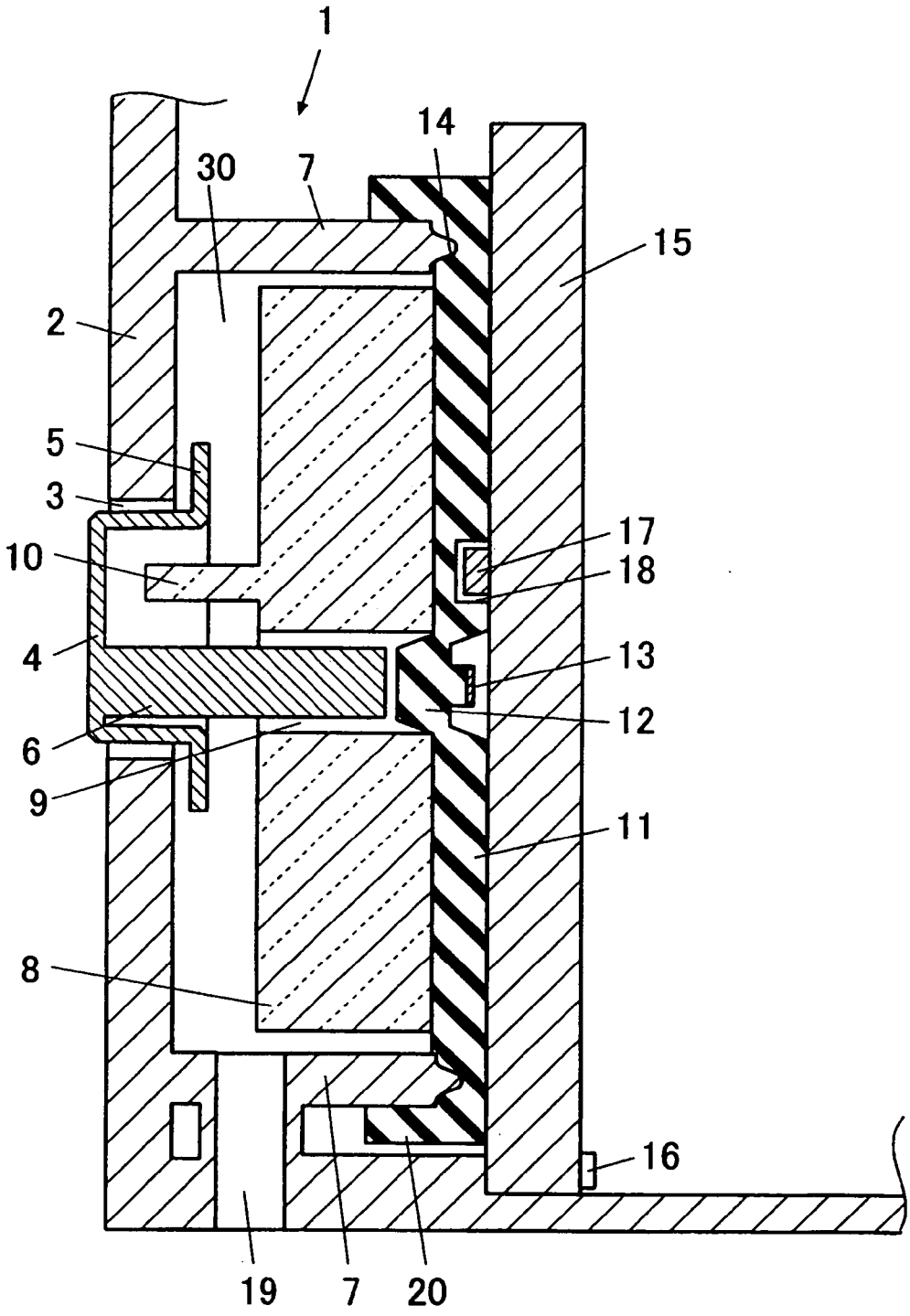
FIG. 3 is a sectional view of a button waterproofing structure 1.

FIG. 1 is an exploded perspective view of a button waterproofing structure 1, viewed from the front, FIG. 2 is an exploded perspective view of a button waterproofing structure 1, viewed from the back, and FIG. 3 is a sectional view of a button waterproofing structure 1.

This button waterproofing structure 1 can be used for electronic equipment mounted on an instrument panel of a transporting means, such as a ship, yacht, boat, motorcycle, and car, and on a building wall surface of bathroom, toilet room, kitchen, and the like. The front of electronic equipment is covered with a box-shaped front panel 2, and the electronic equipment is mounted on the instrument panel or the wall so that the front panel 2 is exposed facing to the front.

Through the front panel 2, a plurality of button holes 3 penetrate from the front surface to the back surface, and buttons 4 are inserted in the button holes 3. The button 4 is formed into a cup shape such as to open at the rear, and a flange 5 is provided along an opening on the rear side of the button 4, so that the flange 5 comes into contact with the back surface of the front panel 2 and thereby the button 4 is prevented from coming off to the front through the button hole 3. Also, a column 6 is erected on the cup bottom of the button 4, and projects toward the rear. A part or the whole of the cup bottom of the button 4 is transparent or semitransparent so that light penetrates the cup bottom of the button 4.

On the back surface of the front panel 2, a rib 7 is projectingly provided, and the tip portion on the rear side of the rib 7 is formed into a step shape so that the tip portion has a small thickness. This rib 7 is provided in a frame form so as to surround the button holes 3.

In a space 30 surrounded by the rib 7, a transparent plate 8 is fitted. A plurality of support holes 9 penetrate the transparent plate 8, and each of the support holes 9 is located at a position corresponding to the column 6 of the button 4. The column 6 of the button 4 is inserted in the support hole 9, and thereby the button 4 is supported in a state of being movable in the front and rear direction.

On the front surface of the transparent plate 8, a plurality of light guide portions 10 are projectingly formed. Each of the light guide portions 10 is located at a position corresponding to the button 4, and the tip end portion of the light guide portion 10 is inserted in the cup of the button 4. The tip end of the light guide portion 10 is separate from the cup bottom of the button 4.

The space 30 surrounded by the rib 7 is closed by a rubber sheet 11, and the rear surface of the transparent plate 8 abuts on the front surface of the rubber sheet 11. The rubber sheet 11 has insulating properties and rubber elasticity, and also has light transmitting properties because of being transparent or semitransparent. In this example, the rubber sheet 11 consists of a cloudy silicone rubber so that light penetrates it. The rubber sheet 11 is provided with a plurality of contact portions 12. Each of the contact portions 12 is located at a position corresponding to the column 6 of the button 4, and a part of the contact portion 12 is inserted in the support hole 9 in the transparent plate 8. On the rear surface of the contact portion 12, a conductive thin film 13 such as black carbon is formed.

In a front edge portion of the rubber sheet 11, an engagement groove 14 is concavely provided. This engagement groove 14 is formed over the whole circumference of front edge portion of the rubber sheet 11, and the rib 7 is engaged with the engagement groove 14 over the whole thereof. The engagement groove 14 is a two-step groove such as to match the shape of the tip portion of the rib 7. Further, in a front edge portion of the rubber sheet 11, a frame portion 20 is convexly provided so as to surround the engagement groove 14. The rib 7 is fitted in the frame portion 20 and is surrounded by the frame portion 20. The frame portion 20 is formed integrally with the rubber sheet 11, and has insulating properties and rubber elasticity.

On the rear surface of the rubber sheet 11, a circuit board 15 is lapped. Screws 16 penetrate the circuit board 15 and are threadedly engaged with the front panel 2. By the fastening of the screws 16, the edge portion of the rubber sheet 11 is held between the circuit board 15 and the rib 7. Therefore, the rubber sheet 11 functions as a packing, and hence a gap between the rib 7 and the circuit board 15 is sealed.

At positions on the front surface of the circuit board 15, which correspond to the contact portions 12, end portions 21 of printed wiring are provided. By bringing the conductive thin film 13 into contact with the end portion 21 of printed wiring, the printed wiring is short-circuited.

On the front surface of the circuit board 15, a plurality of light emitting elements (for example, LEDs) 17 are mounted. At positions on the rear surface of the rubber sheet 11, which correspond to the light emitting elements 17, accommodation concave portions 18 are formed so that the light emitting elements 17 are accommodated in the accommodation concave portions 18. These light emitting elements 17 and the accommodation concave portions 18 are located at positions corresponding to the light guide portions 10, respectively.

Positioning holes 22 penetrate the circuit board 15, and protrusions 23 are formed on the rear surface of the rubber sheet 11. By inserting the protrusions 23 in the positioning holes 22, the circuit board 15 is positioned with respect to the rubber sheet 11.

In the lower surface of the front panel 2, a drain hole 19 is formed. This drain hole 19 penetrates to the rib 7. Therefore, the space 30 surrounded by the rib 7 communicates with the outside through the drain hole 19.

In the waterproofing structure 1 constructed as described above, when the user pushes the button 4 toward the rear with a finger etc., the contact portion 12 is pressed by the tip end of the column 6, so that the conductive thin film 13 comes into contact with the circuit board 15. Thereby, the end portion 21 of printed wiring is short-circuited, and thereby the electronic equipment is turned on. When the user releases the button 4, the button 4 is returned to its original position together with the contact portion 12 by the elastic force of the rubber sheet 11, and hence the conductive thin film 13 is separated from the circuit board 15.

When the light emitting element 17 emits light, the light of the light emitting element 17 penetrates the rubber sheet 11 and enters into the transparent plate 8. The light entering into the transparent plate 8 transmits through the light guide portion 10, and comes out of the front end surface of the light guide portion 10, so that the button 4 shines. The shining of the button 4 improves the design grade and enhances a sense of high class.

Also, since the light of the light emitting element 17 is transmitted by the light guide portion 10, the light does not leak, so that the button 4 can be shone brightly. Also, since the light emitting element 17 and the light guide portion 10 just face to the button 4, the button 4 can be prevented from being shone by the light of the nearby light emitting element 17.

Although the light emitting element 17 is mounted in a state of being projected, the rubber sheet 11 can be brought into close contact with the circuit board 15 because the light emitting element 17 is accommodated in the accommodation concave portion 18. Also, since the rubber sheet 11 is thin at the location of the accommodation concave portion 18, the light of the light emitting element 17 penetrate efficiently, and hence the button 4 can be shone brightly.

Also, even if water intrudes from the outside through a gap between the button 4 and the front panel 2, since the rubber sheet 11 is held between the rib 7 and the circuit board 15, the water does not intrude farther. Therefore, even if water showers down onto the front surface of the front panel 2, the circuit board 15 and other electrical elements located at the rear of the rubber sheet 11 can be waterproofed. Therefore, the life of equipment is not shortened, and also the operation of equipment is not adversely affected.

Water intruding into the space 30 surrounded by the ribs 7 is discharged to the outside through the drain hole 19, so that water is less liable to accumulate in the space 30 surrounded by the rib 7. In particular, since the drain hole 19 is formed in the lower surface of the front panel 2, water is drained efficiently.

Also, since the rubber sheet 11 is located at the rear of the button 4, and the front side of the button 4 is not covered with the rubber sheet 11, the design grade is improved, and a sense of high class is enhanced.

Also, when the button 4 is pushed with a finger etc., resilience of the rubber sheet 11 acts on the fingertip, so that the feeling at the time when the button 4 is pushed is almost the same as that of the conventional pushbutton.

In FIG. 3, the front-side end portion of the frame portion 20 is separate from the back surface of the front panel 2. However, the projection length of the frame portion 20 may be made long so that the front-side end portion of the frame portion 20 is in close contact with the back surface of the front panel 2. By bringing the front-side end portion of the frame portion 20 into close contact with the front panel 2, the waterproofness is further improved.

Second Embodiment

Figure 4:
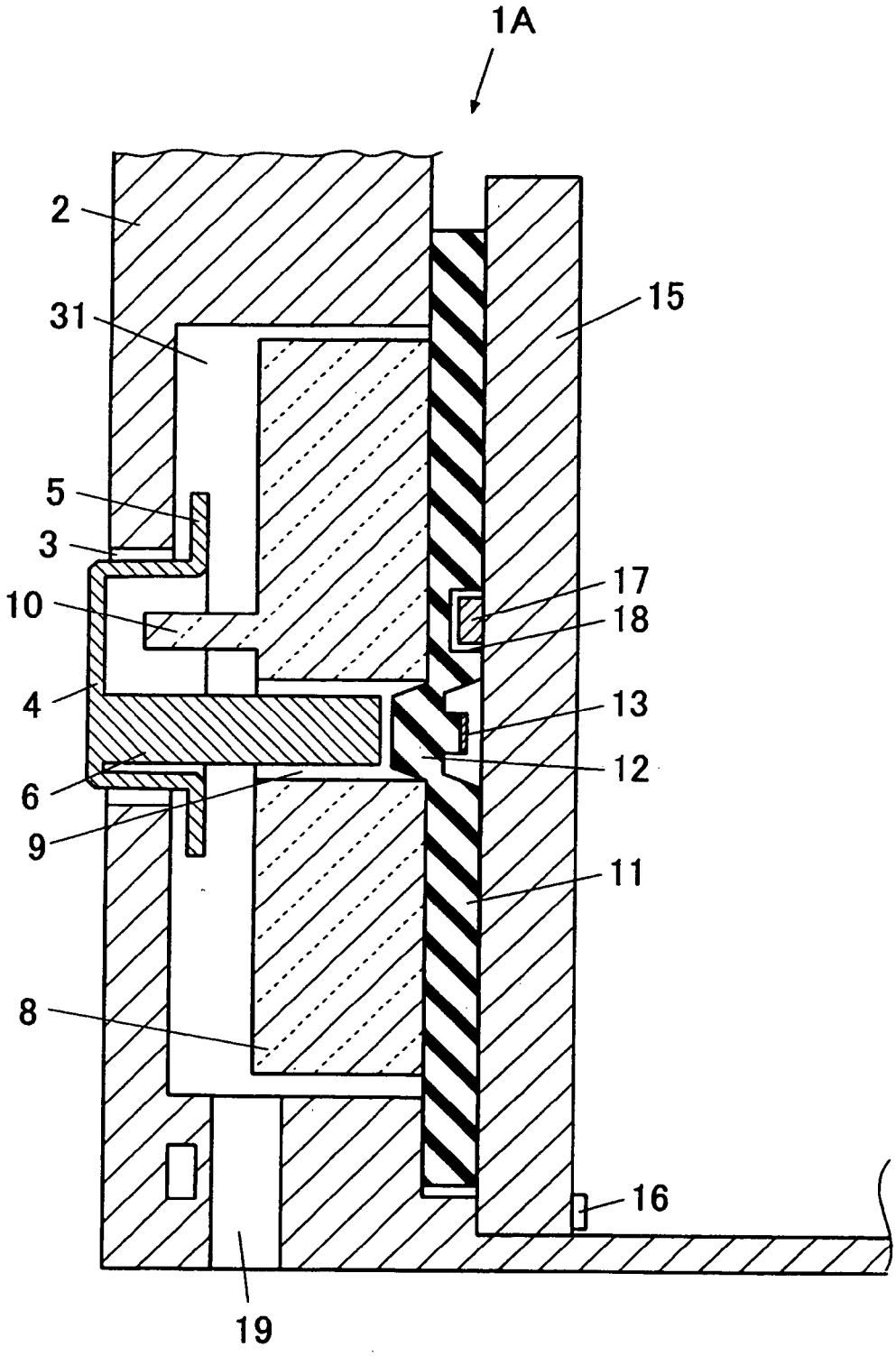
FIG. 4 is a sectional view of a button waterproofing structure 1A.

A button waterproofing structure 1A in accordance with a second embodiment will be described with reference to FIG. 4. FIG. 4 is a sectional view of the button waterproofing structure 1A. In the description below, for the button waterproofing structure 1A, the same reference numerals are applied to elements that correspond to the elements of the button waterproofing structure 1 of the first embodiment.

The front-to-back thickness of the front panel 2 of this button waterproofing structure 1A is larger than the front-to-back thickness of the front panel 2 of the button waterproofing structure 1, and a concave portion 31 is formed in the back surface of the front panel 2. This concave portion 31 corresponds to the space 30 of the first embodiment. Therefore, the rib 7 as described in the first embodiment is not formed on the back surface of the front panel 2.

At the bottom of the concave portion 31, the plurality of button holes 3 (in FIG. 4, only one button hole 3 is shown) are formed. These button holes 3 penetrate to the front surface of the front panel 2.

The concave portion 31 is covered with the rubber sheet 11, and the peripheral portion of the rubber sheet 11 is held between the back surface of the front panel 2 and the circuit board 15. Therefore, even if water intrudes from the outside through the gap between the button 4 and the front panel 2, since the concave portion 31 is closed by the rubber sheet 11, and the rubber sheet 11 is held between the circuit board 15 and the front panel 2, the water does not intrude farther, so that the life of equipment is not shortened, and also the operation of equipment is not adversely affected.

The frame portion 20 is not formed in the front surface edge portion of the rubber sheet 11.

In the second embodiment as well, since the rubber sheet 11 is located at the rear of the button 4, and the front side of the button 4 is not covered with the rubber sheet 11, the design grade is improved, and a sense of high class is enhanced.

Excluding the elements described above, the elements of the button waterproofing structure 1A in accordance with the second embodiment are provided in the same way as the corresponding elements of the button waterproofing structure 1 in accordance with the first embodiment.

Third Embodiment

Figure 5:
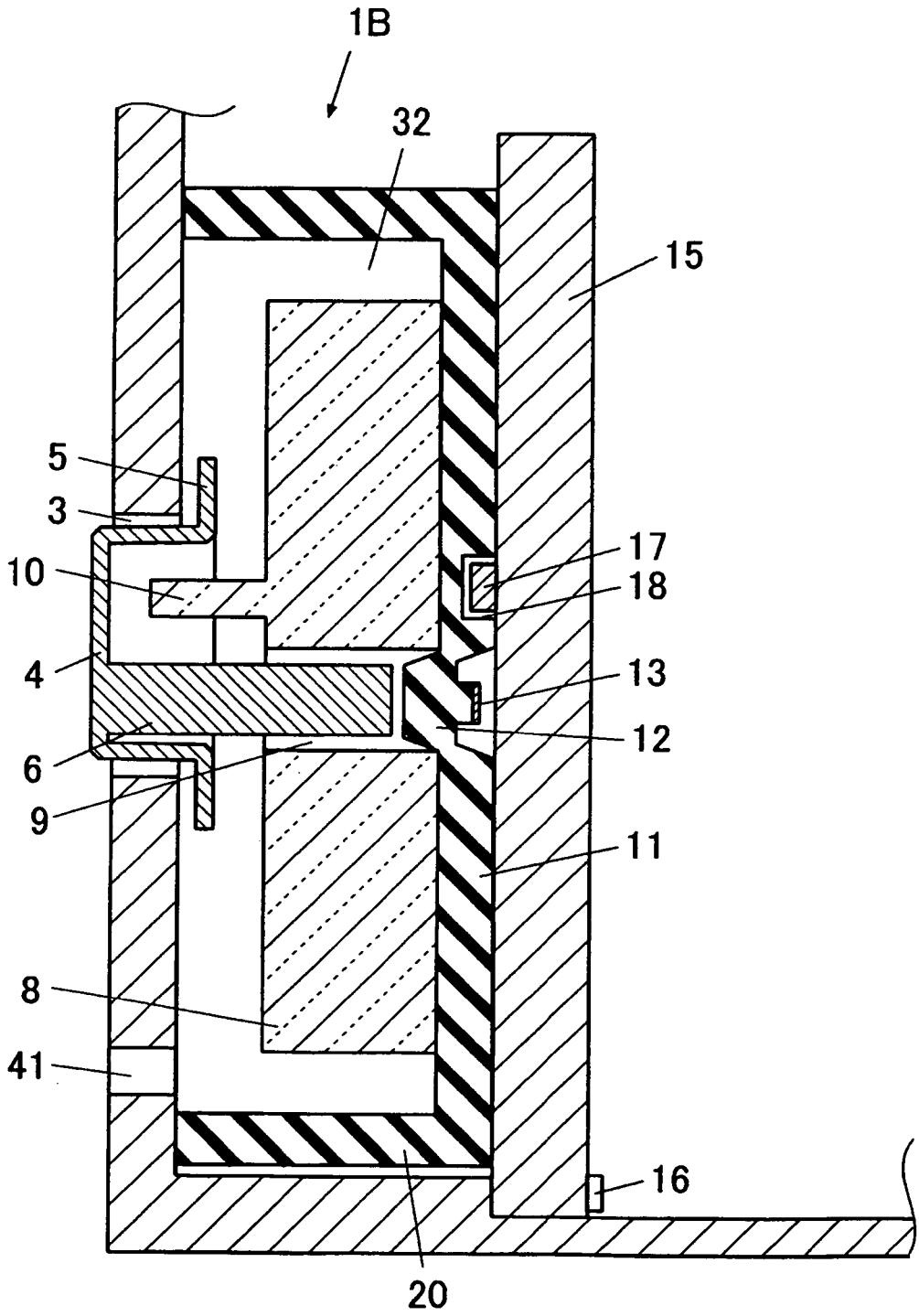
FIG. 5 is a sectional view of a button waterproofing structure 1B.

A button waterproofing structure 1B in accordance with a third embodiment will be described with reference to FIG. 5. FIG. 5 is a sectional view of the button waterproofing structure 1B. In the description below, for the button waterproofing structure 1B, the same reference numerals are applied to elements that correspond to the elements of the button waterproofing structure 1 of the first embodiment.

On the back surface of the front panel 2 of the button waterproofing structure 1B, the rib 7 as described in the first embodiment is not formed. On the other hand, as in the case of the first embodiment, the frame portion 20 is convexly provided in the front surface edge portion of the rubber sheet 11, and the front-side end portion of the frame portion 20 is in close contact with the front panel 2 so as to surround the plurality of button holes 3 (in FIG. 4, only one button hole 3 is shown). The circuit board 15 is installed with the screws 16, and by the fastening of the screws 16, the frame portion 20 is held between the front surface of the circuit board 15 and the back surface of the front panel 2. The frame portion 20 has rubber elasticity, and is compressed by being held between the front surface of the circuit board 15 and the back surface of the front panel 2. The transparent plate 8 is accommodated in a space 32 surrounded by the frame portion 20 and the rubber sheet 11.

As described above, the space 32 on the rear side of the button holes 3 is surrounded by the frame portion 20 and the rubber sheet 11. Therefore, even if water intrudes from the outside through the gap between the button 4 and the front panel 2, the water does not intrude farther, so that the life of equipment is not shortened, and also the operation of equipment is not adversely affected.

In the third embodiment, the drain hole 19 as described in the first embodiment is not formed, but a drain hole 41 is formed on the front surface lower side of the front panel 2, and the drain hole 41 communicates with the space 32.

In the third embodiment as well, since the rubber sheet 11 is located at the rear of the button 4, and the front side of the button 4 is not covered with the rubber sheet 11, the design grade is improved, and a sense of high class is enhanced.

Excluding the elements described above, the elements of the button waterproofing structure 1B in accordance with the third embodiment are provided in the same way as the corresponding elements of the button waterproofing structure 1 in accordance with the first embodiment.

The present invention is not limited to the above-described embodiments, and various modifications and design changes may be made without departing from the spirit and scope of the present invention.

In the above-described embodiments, an LED is used as the light emitting element 17. However, an electroluminescent element or a fluorescent lamp may be used in place of the LED.

What is claimed is:

1. A button waterproofing structure for an electronic equipment in which at least one button is arranged in a corresponding button hole in a panel; a rib formed integrally with the panel and convexly provided on a rear surface of the panel surrounds the button hole; a light transmitting rubber sheet, which is a member physically separated from said button, seals a panel rear space surrounded by the rib and is held between a circuit board and the rib; a contact portion is provided on a rear surface of the rubber sheet so as to correspond to the button in such a manner as to be brought into contact with and separated from the circuit board by the elastic force of the rubber sheet; and a light emitting element is mounted on the circuit board so as to correspond to the button and is covered with the rubber sheet wherein a groove is formed in a front surface of the rubber sheet so as to correspond to the rib; and the rib engages with the groove by being tightly filled with the rib so that the panel rear space surrounded by the rib is sealed from an inner space of the equipment by the rubber sheet and the rib, and wherein said panel rear space has a drain hole which communicates with an outside of the equipment to drain water flowing through the button hole into the panel rear space.

2. The button waterproofing structure according to claim 1, wherein a concave portion is formed in the back surface of the rubber sheet; and the light emitting element is accommodated in the concave portion.

3. The button waterproofing structure according to claim 1, wherein a light guide portion for guiding the light of the light emitting element to the button is provided between the button and the rubber sheet.

4. An electronic equipment provided with a waterproofing structure, comprising:

a panel (2) having a plurality of button holes (3) and a rib (7) integrally formed with the panel and convexly formed on the rear surface thereof and surrounding a panel area at which said plurality of button holes are formed;

a plurality of button holes (4), each having a column member (6) which passes through a corresponding one of said plurality of button holes;

a rubber sheet (11) having a groove (14) formed on a front surface thereof and engaged with the rib (7) by being tightly filled with the rib so that a panel rear space surrounded by the rib is sealed from an inner space of the equipment by the rubber sheet and the rib; and a circuit board disposed opposing a rear surface of the rubber sheet in the inner space of the equipment, and having switches each of which corresponds to each of the column members of said plurality of buttons;

wherein said plurality of buttons are parts physically separated from said rubber sheet and said panel rear space sealed from the inner surface of the equipment has a drain hole (19) which communicates with an outside of the equipment of drain water flowing through said plurality of button holes into said panel rear space.

5. An electronic equipment according to claim 4, wherein said rubber sheet is made out of light transmitting rubber.

6. An electronic equipment according to claim 5, further comprising a transparent plate (8) disposed between the panel and the rubber sheet and provided with a light guide (10) which extends to the vicinity of the button so that a light introduced into the transparent plate (9) is guided to the button.

7. An electronic equipment according to claim 6, wherein a light source is disposed on the circuit board and a light from the light source is introduced through the rubber sheet into the transparent plate.

8. An electronic equipment according to claim 4, wherein said rubber sheet has a frame (20) convexly formed along the groove (14).

* * * * *